United States Patent [19]

Copland et al.

[11] Patent Number: 4,684,025

[45] Date of Patent: Aug. 4, 1987

[54] SHAPED THERMOFORMED FLEXIBLE FILM CONTAINER FOR GRANULAR PRODUCTS AND METHOD AND APPARATUS FOR MAKING THE SAME

[75] Inventors: Donald S. Copland, Lebanon; Larry D. Halstead, Hamilton; Lawrence E. O'Brien, Cincinnati, all of Ohio

[73] Assignee: The Procter & Gamble Company, Cincinnati, Ohio

[21] Appl. No.: 823,917

[22] Filed: Jan. 30, 1986

[51] Int. Cl.[4] ..... B65B 1/24

[52] U.S. Cl. ..... 206/484; 53/434; 53/453; 53/526; 53/559

[58] Field of Search ..... 53/433, 434, 436, 456, 53/453, 122, 511, 527, 526, 559, 560, 561; 206/484

[56] References Cited

U.S. PATENT DOCUMENTS

| | | | |
|---|---|---|---|
| 2,124,959 | 7/1938 | Vogel | 226/82 |
| 3,069,273 | 12/1962 | Wayne | 99/171 |
| 3,196,590 | 7/1965 | Ollier et al. | 53/112 |
| 3,283,469 | 11/1966 | McBrady et al. | 53/22 |
| 3,340,668 | 9/1967 | Bofinger | 53/22 |
| 3,363,395 | 1/1968 | King | 53/112 |
| 3,398,500 | 8/1968 | Inman | 53/22 |
| 3,467,244 | 9/1969 | Mahaffy et al. | 206/45.34 |
| 3,469,364 | 9/1969 | Bischoff | 53/37 |
| 3,478,488 | 11/1969 | Jensen et al. | 53/112 |
| 3,491,504 | 1/1970 | Young et al. | 53/22 |
| 3,492,773 | 2/1970 | Bergstrom | 53/22 |
| 3,521,422 | 7/1970 | Tabor | 53/15 |
| 3,545,163 | 12/1970 | Mahaffy et al. | 53/22 |
| 3,673,760 | 7/1972 | Canamero | 53/22 |
| 3,750,362 | 8/1973 | Kishpaugh et al. | 53/433 |
| 3,956,867 | 5/1976 | Utz et al. | 53/22 |
| 4,058,953 | 11/1977 | Sanborn, Jr. et al. | 53/433 |
| 4,201,030 | 5/1980 | Mahaffy | 53/432 |
| 4,211,326 | 7/1980 | Hein et al. | 206/484 |
| 4,275,544 | 6/1981 | Hisazumi et al. | 53/433 |
| 4,338,765 | 7/1982 | Ohmori et al. | 53/452 |
| 4,411,122 | 10/1983 | Cornish et al. | 53/436 |
| 4,424,659 | 1/1984 | Perigo et al. | 53/425 |
| 4,513,015 | 4/1985 | Clough | 426/396 |
| 4,541,224 | 9/1985 | Mugnai | 53/434 |
| 4,541,225 | 9/1985 | Byland | 53/441 |
| 4,545,177 | 10/1985 | Day | 53/434 |
| 4,545,180 | 10/1985 | Chung et al. | 53/456 |
| 4,548,018 | 10/1985 | Wojnicki | 53/51 |
| 4,549,386 | 10/1985 | Wilson | 53/51 |
| 4,549,387 | 10/1985 | Marshall et al. | 53/469 |
| 4,550,548 | 11/1985 | Owensby et al. | 53/434 |
| 4,567,713 | 2/1986 | Natterer | 53/433 |
| 4,571,924 | 2/1986 | Bahrani | 53/453 |

*Primary Examiner*—James F. Coan

*Attorney, Agent, or Firm*—John J. Ryberg; E. Kelly Linman; John V. Gorman

[57] ABSTRACT

A thermoformed container having a granular product therein being made from two webs of films of flexible material is provided. According to one embodiment of the present invention, a web of flexible film material is thermoformed into a series of cup-shaped containers, each cup having a peripheral flange around its mouth. The cups are then partially filled with a granular product such that there is a headspace between the product's top surface and the cup's peripheral flange. The cups are then placed in a vacuum/sealing/shaping chamber wherein substantially all the air inside the cups is removed, followed by sealing an upper web of flexible film material to each cups's peripheral flange. Before the sealed containers are removed from the vacuum/sealing/shaping chamber, a shaping die located in the bottom of the chamber is thrust upwardly into each cup's bottom wall. The shaping die forces the granular product up into the headspace and pushes the cup's excess film material upwardly, thereby forming a concave impression or dome in the cup's bottom wall and subsequently reducing the amount of film wrinkling exhibited by the containers. The chamber is then returned to atmospheric pressure before the containers are removed. Atmospheric pressure holds the containers in this pre-selected solid shape, which is not only easy to handle in subsequent operations, but much more aesthetically pleasing than if the containers were not given a preselected shape. In addition, the reduced wrinkling of the lower cup's film material significantly increases the container's scuff and abrasion resistance.

22 Claims, 7 Drawing Figures

SHAPED THERMOFORMED FLEXIBLE FILM CONTAINER FOR GRANULAR PRODUCTS AND METHOD AND APPARATUS FOR MAKING THE SAME

TECHNICAL FIELD

The present invention pertains to thermoformed containers, and more particularly to thermoformed containers for granular products wherein the container is made from flexible film materials and shaped to assume a predetermined, solid configuration having an aesthetically attractive appearance. The present invention also pertains to a method and apparatus for making such shaped, flexible film containers.

BACKGROUND OF THE INVENTION

Thermoformed vacuumed containers are well known in the art of packaging rigid products such as hot dogs and cheeses. The automatic packaging machines in commercial use typically assemble such containers from two continuous webs of plastic material that are supplied as rollstock. In such machines, a lower web of rigid material is first thermoformed into a series of cup-shaped lower containers, each cup having a peripheral flange around its mouth. Thereafter, a rigid product is placed within each cup before they are indexed to an evacuation/sealing chamber. Inside the chamber, the cups are evacuated, followed by heat sealing an upper web to the peripheral flange surrounding each cup. The series of heat-sealed cups are then removed from the evacuation/sealing chamber for further processing, which typically includes cutting or stamping the series of cups into individual packages ready to be placed inside shipping cartons.

In order to achieve material cost savings, some thermoform/vacuum processes utilize webs of flexible material in packaging rigid products. When such flexible film packages are evacuated, sealed, and removed from the sealing/evacuation chamber, the pressure differential between inside and outside the package causes the flexible film to shrivel into close contacting relation with the product therein. Since the product is rigid and has a relatively constant shape, the package's final shape is the same as the product itself, which typically is an easy to handle shape such as square or rectangular. Therefore, using flexible films in vacuum packing rigid products is a relatively simple matter.

Special care must be taken when granular or flowable products are vacuum packed within thermoformed containers. As pointed out in U.S. Pat. No. 4,424,659, which issued to Perigo et al. and is hereby incorporated herein by reference, it is necessary to leave a "headspace" between the surface level of the flowable product and the heat-sealing surface of the cup's peripheral flange in order to avoid contaminating this surface or otherwise causing interference between the upper web and the sealing surface during the heat-sealing operation. The headspace is particularly necessary when vacuum packaging a light granular product such as ground coffee because turbulence created during the evacuation step can draw granules out of the cup and deposit them on the cup's flange.

In order to achieve substantial material cost savings over the shape retaining, thermoformed containers of the type generally disclosed in Perigo, the present invention utilizes thin, non-shape retaining or flexible films in vacuum packing granular products. However, it has been found that using flexible film material for the lower cup presents several troublesome problems. Specifically, when such a flexible film container filled with a granular product is removed from the sealing/evacuation chamber, atmospheric pressure outside the container shrivels the lower cup and pushes the product up into the headspace. Since the product does not have a shape of its own, the resultant package assumes a random shape that is very difficult to handle during subsequent processing operations. In addition, such a shrivelled, randomly-shaped package has an outer appearance that looks something like a prune. It has been found that most consumers find such a package unattractive. Finally, the randomly-shaped and shrivelled film often includes sharp ridges and valleys that are prone to scuffing and abrasion during subsequent handling operations. If the scuffing or abrasions are excessive the film might develop small holes which would allow oxygen to enter the package and product to escape.

In light of the above, a principal object of the present invention is to achieve significant material cost savings in vacuum packaging a granular produce in a thermoformed container by making the container's lower cup from flexible, non-shape retaining films.

Another principal object of the present invention is to provide a thermoformed, flexible film, vacuumed container having a granular product therein with a predetermined, constant shape.

Another principal object of the present invention is to provide a thermoformed, flexible film, vacuumed container having a granular product therein with an aesthetically pleasing appearance.

Another object of the present invention is to provide a thermoformed, flexible film, vacuumed container that exhibits a reduced amount of wrinkling and a corresponding higher degree of abrasion resistance.

Another object of the present invention is to provide a thermoformed, flexible film, vacuumed container that is solid, relatively easy to open, and exhibits good oxygen and moisture barrier properties.

A further object of the present invention is to provide an economical manufacturing method of making reshaped, vacuumed, flexible film packages for granular products.

Another object of the present invention is to provide efficient apparatus for making reshaped, vacuumed, flexible film packages for granular product.

SUMMARY OF THE INVENTION

The present invention provides an economical, thermoformed container for granular products that is made from two webs or films of flexible material. According to one embodiment of the present invention, a web of flexible film material is thermoformed into a series of cup-shaped containers, each cup having a peripheral flange around the cup's mouth. The cups are then partially filled with a granular product such that there is a headspace between the product's top surface and the cup's peripheral flange. The cups are then placed in a vacuum/sealing/shaping chamber wherein substantially all the air inside the cups is removed, followed by sealing an upper web of flexible film material to each cup's peripheral flange. Before the sealed containers are removed from the vacuum/sealing/shaping chamber, a shaping die located in the bottom of the chamber is thrust upwardly into each cup's bottom wall. The shaping die forces the granular product up into the headspace and pushes the cup's excess film material upwardly, thereby forming a concave impression or dome in the cup's bottom wall. The chamber is then returned to atmospheric pressure before the containers are removed. Atmospheric pressure holds the containers in this pre-selected solid shape, which is not only easy to handle in subsequent operations, but also exhibits a substantially reduced amount of wrinkling that is much more aesthetically pleasing than if the containers were not given a preselected shape. The reduced wrinkling also improves scuff and abrasion resistance.

The present invention also provides apparatus for making thermoformed, vacuumed, shaped, flexible film containers of the present invention.

BRIEF DESCRIPTION OF THE DRAWINGS

While the specification concludes with claims particularly pointing out and distinctly claiming the subject matter regarded as forming the present invention, it is believed that the invention will be better understood from the following description and drawings in which:

DETAILED DESCRIPTION OF THE INVENTION

In the following detailed description of the present invention, the same numeral is used to indicate common apparatus and workpiece components found in each illustration. In addition, the terms "web" and "film" are used synonymously throughout. Finally, the frame, transport means, vacuum sources, and means for moving the various apparatus components and the like which must necessarily be provided with respect to the functional members of the disclosed apparatus are not shown in the figures or described in detail in order to simplify and more clearly disclose the present invention, it being understood that such details are well within the knowledge of those skilled in the art of making thermoformed/filled/vacuumed/sealed containers.

Figure 1:
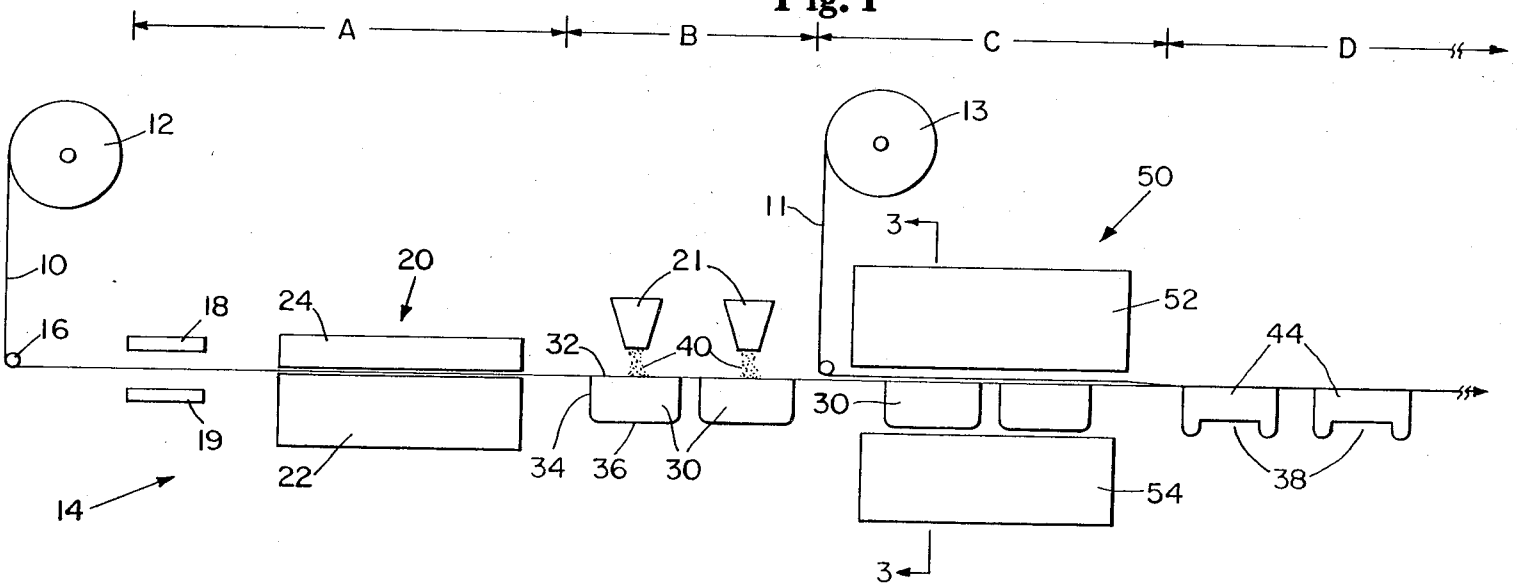
FIG. 1 is a schematic side view of an apparatus for making thermoformed, vacuumed, shaped, flexible film containers for packaging granular products.

FIG. 1 is a schematic side view of a particularly preferred apparatus that is utilized in making thermoformed/filled/vacuumed/sealed/shaped containers of the present invention. In FIG. 1, a lower web or film of material 10, supplied from rollstock 12, is fed into the apparatus generally indicated as 14 from left to right. From rollstock 12, film 10 is drawn first downwardly to guide roller 16, then horizontally indexed through successive zones A, B, C and D of apparatus 14. Zone A is the thermoforming component of apparatus 14 wherein film 10 is first heated above its softening temperature by upper and/or lower heating elements 18 and 19, then drawn into a thermoformer generally indicated as 20 and preferably comprising lower chamber 22 and top plate 24. The interior portion of lower chamber 22 defines a mold cavity of a shape corresponding to that required for the bottom wall and side walls of the lower cups to be formed. As illustrated, thermoformer 20 simultaneously forms a 2×2 block of lower cups, although any convenient number and arrangement of cups may be selected.

Briefly, after the heated and softening film 10 is indexed into thermoformer 20, top plate 24 is lowered into sealing engagement with lower chamber 22 as shown. After plate 24 and chamber 22 are closed, a pressure differential is created on opposite sides of film 10 whereby film 10 is drawn and stretched into contacting relation with the interior side walls and bottom wall of lower chamber 22 to form a plurality of cup-shaped containers 30 (hereinafter "cups"), each cup having a peripheral flange 32 around its mouth or charging opening. Alternatively or in addition, a plug assist member (not shown) having a shape which substantially coincides with the cavities in lower chamber 22 may be provided in the area of top plate 24 and can be used to mechanically form cups 30. In still another embodiment, top plate 24 could be eliminated altogether. In the latter case the cups can be formed by establishing a seal between film 10 and the uppermost surface of lower chamber 22 and applying a vacuum to the interior portion of the lower chamber. In drawing and stretching film 10, side walls 34 and bottom end wall 36 of cups 30 become thin and flexible. As used herein, the term "flexible" means incapable of maintaining a fixed shape by itself, i.e. non-shape retaining. By making cups 30 thin and flexible, substantial material cost savings over other prior art rigid thermoformed containers can be realized.

After cups 30 have cooled, thermoformer 20 is opened and cups 30 are indexed to zone B of apparatus 14. In zone B, charging hoppers 21 fill each cup 30, preferably by gravity, with a pre-selected quantity of a granular produce 40 to a level below the upper peripheral flange 32 of cup 30, thereby leaving a headspace. In charging cups 30, it is not practical nor desirable to completely fill each cup because overcharging runs the risk of contaminating the cup's sealing surface, which is upper peripheral flange 32, during the sealing operation described hereinafter.

After cups 30 are charged with a predetermined quantity of a granular product 40, the cups are indexed to zone C of apparatus 14, which comprises a vacuum/sealing/shaping chamber (hereinafter "VSS chamber") generally indicated as 50, the function of which will be described hereinafter in detail with reference to FIGS. 3–6. Briefly, after filled cups 30 are indexed into VSS chamber 50, upper sealing die 52 and lower sealing die 54 are closed in sealing engagement around cups 30. Thereafter, air is evacuated from within VSS chamber 50, followed by sealing an upper film 11 fed in VSS chamber 50 from rollstock 13 to the peripheral flange 32 of each cup 30. Before VSS chamber 50 is returned to atmospheric pressure, a moveable shaping die located in the bottom for lower sealing die 54 is rammed into the bottom wall 36 of cup 30. The upward movement of the shaping die redistributes the granular product inside cup 30 up into the headspace and makes a concave impression or dome 38 in bottom wall 36 of cup 30, thereby taking up the excess film material. The shaping die is held in its upward position until VSS chamber is returned to atmospheric pressure. After VSS chamber 50 is returned to atmospheric pressure, upper sealing die 52 and lower sealing die 54 are separated, followed by indexing finished containers 44 into zone D. In zone D, the series of sealed, shaped containers 44 are severed from the continuous web and placed in cartons for shipping.

When VSS chamber 50 is returned to atmospheric pressure and opened as described above, it is particularly significant that the pressure differential between the interior and exterior of container 44 holds the container in the fixed shape given to it by the forming die. Of further significance is that the pressure differential helps hold top film 11 to peripheral flange 32 of cup 30, which makes it possible to make a weaker seal between the two than would otherwise be the case, which in turn makes it easy for a consumer to peel top film 11 away from container 44 when the container is opened.

Figure 2:
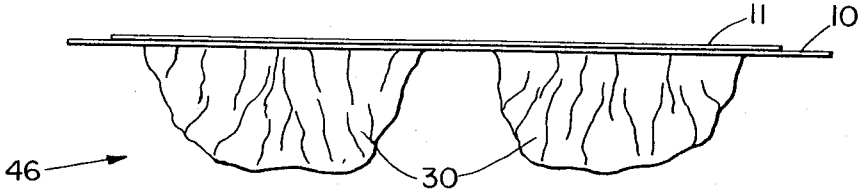
FIG. 2 is a side view of a thermoformed, vacuumed, flexible film container having a granular product therein that has not been shaped into a predetermined configuration according to the present invention.

FIG. 2 is a side view of what container 44 would look like if it were evacuated and sealed but not shaped as described above. In FIG. 2, the pressure differential between the inside and outside of container 46 has caused lower cup 30 to shrivel into a random shape. It has been found that such a randomly-shaped container is extremely difficult to handle in subsequent operations such as packaging individual containers into a shipping carton. In addition, the severe wrinkling exhibited on the outer surface of lower cup 30 gives container 46 an unattrative appearance that looks something like a prune. Furthermore, the sharp peaks resulting from such severe wrinkling provide scuffing and abrasion concentration areas during subsequent handling and shipping operations. In rough environments such as a long distance shipment, the sharp wrinkle peaks can be subjected to enough abrasion to cause holes develop in the film which will allow air to enter the container and product to escape.

Figure 3:
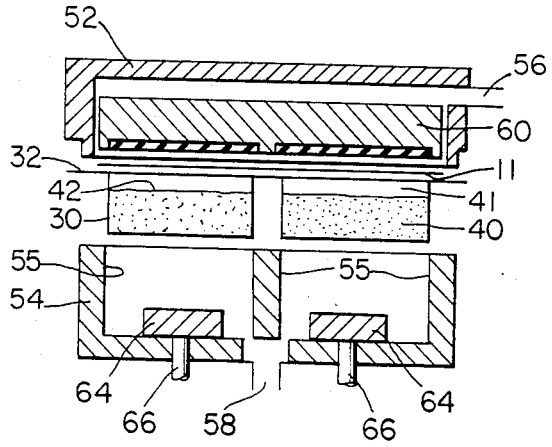
FIGS. 3–6 are cross-sectional schematic views taken along section line 3—3 of FIG. 1, each Figure illustrating various steps that are performed in making thermoformed, vacuumed, shaped containers of the present invention.

The following is a more detailed description of the operational steps performed inside VSS chamber 50 in making shaped flexible film containers of the present invention. FIGS. 3–6 are cross-sectional schematic views of VSS chamber 50 taken along section line 3—3 of FIG. 1 (machine direction). In FIG. 3, a 2×2 configuration of thermoformed filled cups 30 and a continuous web or film 11 of flexible material are indexed within VSS chamber 50. VSS chamber 50 comprises upper sealing die 52 and lower sealing die 54 having a continuously interconnected rigid sidewall 55 defining a pair of adjacent cavities to provide firm support for cups 30 when they are shaped therein. VSS chamber 50 also comprises a sealing plate 60 and upwardly-moveable shaping dies 64 attached to shafts 66. As shown, cups 30 are only partially filled with a granular product 40, thereby leaving a headspace 41 between the top surface 42 of granular product 40 and the upper peripheral flange 32 of cups 30.

Figure 4:
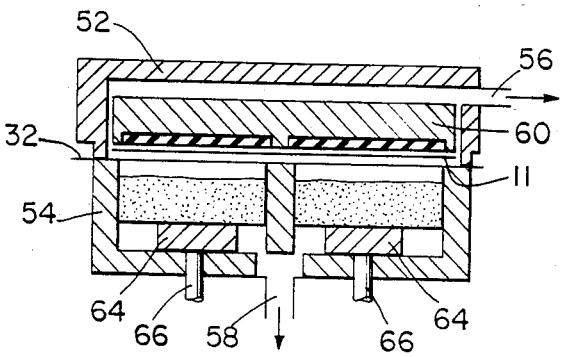

Referring now to FIG. 4, after cups 30 have been indexed into VSS chamber 50, upper sealing die 52 and lower sealing die 54 are closed together in sealing arrangement around cups 30 with peripheral flange 32 of cups 30 provided a seal at their interface. After VSS chamber 50 is closed, air is evacuated from the interior portion of VSS chamber 50 by using a vacuum pump (not shown) connected to vacuum passageway 56 of upper sealing die 52, and vacuum passageway 58 connected to lower sealing die 54.

Figure 5:
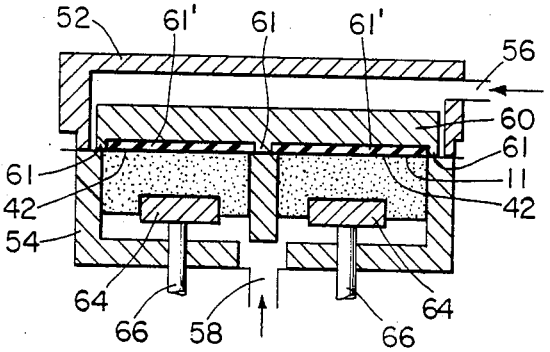

Referring now to FIG. 5, after VSS chamber 50 has been evacuated, sealing plate 60 is lowered such that it brings upper film 11 into contact with peripheral flange 32 surrounding each cup 30. Sealing plate 60 can either use heat or ultrasonics to create seals between upper film 11 and flange 32. If sealing plate 60 uses heat, it preferably has areas 61 that are heated to a temperature sufficient to create a heat seal between upper film 11 and the peripheral flange 32 of cup 30. Areas 61' of sealing plate 60 are preferably maintained at a temperature below the softening temperature of the film so that product granules will not adhere to areas of upper film 11 corresponding to zones 61'. Such a preferred sealing plate 60 might use metal in areas 61 and an insulating material such as silicone rubber for areas 61'.

After sealing plate 60 has formed a heat or ultrasonic seal between upper film 11 and peripheral flange 32 of cup 30, shaping dies 64 located at the bottom of lower sealing die 54 are thrust upwardly into the bottom wall 36 of cup 30 by means of shafts 66 and actuating means (not shown) such as a rotating cam. The upward movement of shaping dies 64 forces bottom end wall 36 of cup 30 upwardly into a concave impression or dome 38 such that granular product 40 is redistributed and fills headspace 41, whereby the upper surface 42 of product 40 comes into continuous contacting relation with upper film 11. While shaping dies 64 are held in the upward position illustrated in FIG. 5, atmospheric pressure is returned inside VSS chamber 50 through passageways 56 and 58. Since the interior cavity of finished containers 44 is substantially below atmospheric, the pressure differential holds containers 44 in the shape provided by shaping dies 64. Such a shape is not only aesthetically attractive, but hydraulically solid and easy to handle. Furthermore, since shaping dies 64 have forced the excess film material up into bottom end wall 36, finished containers 44 will exhibit substantially less film wrinkling than containers 46 illustrated in FIG. 2. Less film wrinkling not only results in a more attractive container, but one which is much less susceptible to localized wearing and pin-holing when the container is subjected to scuffing and abrasion during subsequent handling operations.

Figure 6:
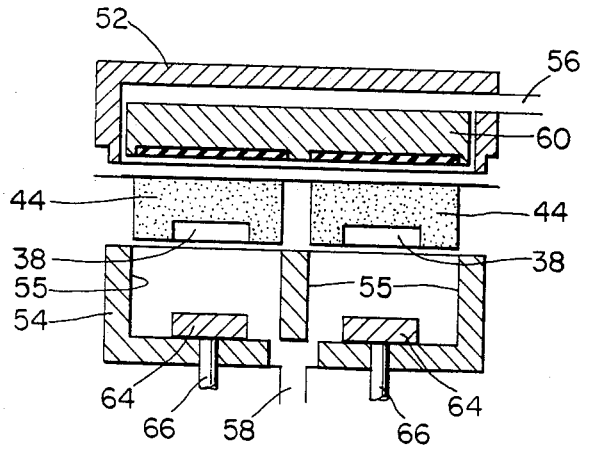

Referring now to FIG. 6, after atmospheric pressure is returned inside VSS chamber 50, upper sealing die 52 and lower sealing die 54 are opened, followed by indexing finished containers 44 into zone D of apparatus 14 where containers 44 are severed from one another and packed in shipping cartons. VSS chamber 50 is now ready to receive another series of filled cups and repeat the evacuating, sealing, and shaping process described above.

Figure 7:
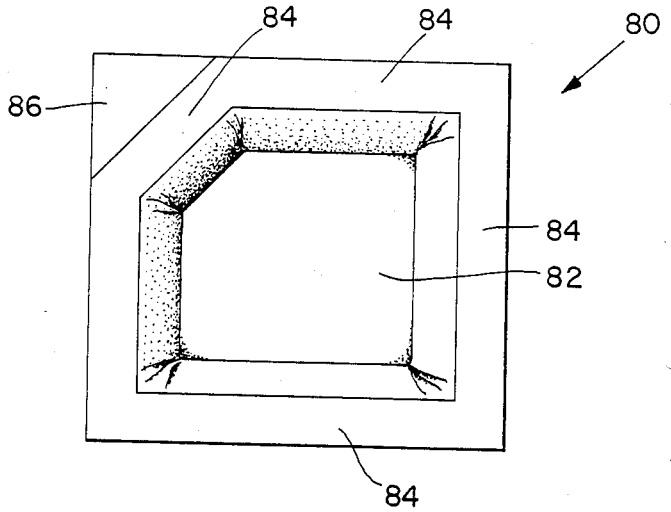
FIG. 7 is a bottom view of a thermoformed, vacuumed, shaped container of the present invention.

FIG. 7 illustrates a bottom view of particularly preferred thermoformed, flexible film container of the present invention. In FIG. 7, container 80 has a pentagon-shaped concave impression or dome 82 stamped in its bottom end wall. Of course, shaping dies 64 and the other components of VSS chamber 50 must have complementary configurations to give such a shape to container 80. Distal edge 84 represents the area where top film 11 and peripheral flange 32 of cup 30 are sealed together. Area 86 is preferably not sealed, which provides a convenient place for a consumer to grasp that corresponding free corner of upper film 11 (top lid) and peel it away from lower cup 30 to open container 80.

As will be appreciated by those skilled in the art, a wide variety of films which satisfy the definition of "flexible" can be utilized in practicing the present invention. For example only, it has been found that a good film for lower cup 30 is a 10–15 mil laminate comprising low density polyethylene/saran/low density polyethylene. Another good film that can be utilized is a 7 mil laminate comprised of nylon/ethylene vinyl alcohol/linear low density polyethylene. Suitable films for upper film 11 include a 4.5 mil laminate comprised of polyester/saran/linear low density polyethylene/EVA sealant, as well as a 2.25 mil laminate comprised of polyester/saran/high density polyethylene/surlyn. Such films provide attractive features such as strength, scuff resistance, oxygen barrier, and moisture barrier.

Apparatus for a method of making a novel and economical thermoformed container for granular products are thus provided. The apparatus shown has been somewhat simplified so that a person skilled in the art of thermoform/vacuum packaging may readily understand the preceding description and readily incorporate the present invention in a high-speed manufacturing environment by making a number of minor modifications and additions thereto, none of which entails a departure from the spirit and scope of the present invention. Accordingly, the following claims are intended to embrace such modifications.

What is claimed is:

1. A sealed, thermoformed container comprised of non-shape retaining flexible film, but exhibiting a preselected, substantially solid shape, said container having a granular product therein and being substantially free of gases, said container comprising:

(a) a lower cup defining a hollow cavity of preselected size and shape thermoformed from a non-shape retaining flexible film, said lower cup having an upper peripheral flange and a bottom wall, said bottom wall being provided with a concave impression also of preselected size and shape extending into said hollow cavity at a preselected location;

(b) a predetermined quantity of said granular product contained within said hollow cavity and having a top surface in the form of a composite of the uppermost granules of said product; and (c) a substantially planar top lid having a distal edge and a bottom surface, said distal edge being continuously and releasably sealed about said upper peripheral flange of said lower cup, said bottom surface of said substantially planar lid being in continuous contacting relation with said top surface of said predetermined quantity of granular product, whereby atmospheric pressure acting upon the exterior surfaces of said sealed, substantially gas-free container maintains said container in said preselected, substantially solid shape until said container is opened.

2. The sealed thermoformed container recited in claim 1 wherein said substantially planar top lid is substantially coextensive with said upper peripheral flange of said lower cup, said top lid having a grasping flap extending outwardly beyond a portion of said distal edge of said top lid, said grasping flap not being sealed to said upper peripheral flange of said lower cup.

3. The sealed thermoformed container recited in claim 1 wherein said non-shape retaining flexible film is selected from the group consisting of polyester, saran, nylon, linear low density polyethylene, low density polyethylene, ethylene vinyl alcohol, ethylene vinyl acetate, surlyn, and laminated layers thereof.

4. The sealed thermoformed container recited in claim 1 wherein said substantially planar top lid is selected from the group consisting of polyester, low density polyethylene, linear low density polyethylene, ethylene vinyl alcohol, ethylene vinyl acetate, saran, nylon, aluminum foil, and laminated layers thereof.

5. The sealed thermoformed container recited in claim 1 wherein said granular product is selected from the group consisting of coffee, sugar, flour, powdered beverage mixes, and powdered detergent.

6. The sealed thermoformed container of claim 1 wherein said substantially planar top lid is also comprised of a non-shape retaining flexible film.

7. A method of making a sealed, thermoformed container of preselected, substantially solid shape from a non-shape retaining flexible film, said container having a granular product therein and being substantially free of gases, said method comprising the steps of:

(a) thermoforming a lower cup from a non-shape retaining flexible film, said lower cup defining a hollow cavity and having a upper peripheral flange and a bottom wall;

(b) filling said hollow cavity of said thermoformed lower cup with a predetermined quantity of said granular product, said granular product having a top surface in the form of a composite of the uppermost granules of said product, said top surface being below said upper peripheral flange of said lower cup;

(c) substantially removing gases from inside said hollow cavity of said lower cup by subjecting said hollow cavity of said lower cup to vacuum;

(d) continuously sealing the distal edge of a substantially planar top lid having a bottom surface about said upper peripheral flange of said lower cup while said top lid, said hollow cavity and said lower cup are subjected to vacuum to form a sealed, substantially gas-free container;

(e) mechanically deforming said bottom wall of lower cup into a concave impression of preselected size and shape extending into said hollow cavity of said lower cup at a preselected location, yet maintaining said top lid in a substantially planar condition while said sealed, substantially gas-free container is subjected to vacuum, thereby moving said top surface of said granular product into continuous contacting relation with said bottom surface of said substantially planar top; and (f) exposing said sealed, substantially gas-free container to atmospheric pressure, thereby causing said container to maintain said preselected, substantially solid shape until it is opened.

8. The method recited in claim 7 wherein said bottom wall of said lower cup is deformed with a moveable shaping die.

9. The method recited in claim 7 wherein said distal edge of said top lid is heat sealed to said upper peripheral flange of said lower cup.

10. The method recited in claim 7 wherein said distal edge of said top lid is ultrasonically sealed to said upper peripheral flange of said lower cup.

11. The method recited in claim 7 wherein said non-shape retaining flexible film is selected from the group consisting of polyester, saran, nylon, linear low density polyethylene, ethylene vinyl alcohol, ethylene vinyl acetate, surlyn, and laminated layers thereof.

12. The method recited in claim 7 wherein said substantially planar top lid is selected from the group consisting of polyester, low density polyethylene, linear low density polyethylene, ethylene vinyl alcohol, ethylene vinyl acetate, saran, nylon, aluminum foil, and laminated layers thereof.

13. The method recited in claim 7 wherein said granular product is selected from the group consisting of coffee, sugar, flour, powdered beverage mixes, and powdered detergent.

14. The method recited in claim 7 wherein a portion of said top lid extending outwardly beyond a portion of said distal edge of said top lid is not sealed to the coinciding portion of said upper peripheral flange of said lower cup, thereby forming a grasping flap for opening said container.

15. An apparatus for making a sealed, thermoformed container of preselected, substantially solid shape from a non-shape retaining flexible film, said container having a granular product therein and being substantially free of gases, said apparatus comprising:

(a) means for thermoforming a lower cup from a non-shape retaining flexible film, said lower cup defining a hollow cavity and having a peripheral flange and a bottom wall;

(b) means for filling said hollow cavity of said thermoformed lower cup with a predetermined quantity of said granular product, said granular product having a top surface in the form of a composite of the uppermost granuels of said product, said top surface being below said peripheral flange of said lower cup;

(c) means for subjecting said hollow cavity of said lower cup to vacuum to substantially remove gases from inside said hollow cavity of said lower cup;

(d) means for sealing the distal edge of a top lid having a planar bottom surface about said upper peripheral flange of said lower cup while said top lid, said hollow cavity and said lower cup are subjected to vacuum to form a sealed, substantially gas-free container;

(e) means for mechanically deforming said bottom wall of said lower cup into a concave impression or preselected size and shape extending into said hollow cavity of said lower cup at a preselected location, yet maintaining said top lid in a substantially planar condition while said sealed, substantially gas-free container is subjected to vaccum, thereby moving said top surface of said granular product into continuous contacting relation with said bottom surface of said substantially planar top lid; and (f) means for exposing said sealed substantially gas-free container to atmospheric pressure, thereby causing said container to maintain said preselected, substantially solid shape until it is opened.

16. The apparatus recited in claim 15 wherein said means for sealing the distal edge of said top lid about said upper peripheral flange of said lower cup comprises an ultrasonic sealing plate.

17. The apparatus recited in claim 15 wherein said means for deforming said bottom wall of said lower cup comprises a moveable shaping die.

18. The apparatus recited in claim 15 wherein said means for substantially removing gases from inside said hollow cavity of said lower cup comprises an upper sealing die and a lower sealing die which when brought together define a sealed vacuum chamber, said vacuum chamber being in fluid communication with a vacuum source.

19. The apparatus recited in claim 15 wherein said means for thermoforming a lower cup includes at least one heating element located adjacent to said non-shape retaining flexible film.

20. The apparatus recited in claim 15 wherein said means for filling said hollow cavity of said lower cup comprises a gravity feed hopper.

21. The apparatus recited in claim 15 wherein said means for sealing the distal edge of said top lid about said upper peripheral flange of said lower cup comprises a heat sealing plate.

22. A method of making a sealed, thermoformed container of preselected, substantially solid shape from a non-shape retaining flexible film, said container having a granular product therein and being substantially free of gases, said method comprising the steps of:

(a) thermoforming a lower cup from a non-shape retaining flexible film, said lower cup defining a hollow cavity and having an upper peripheral flange and a bottom wall;

(b) filling said hollow cavity of said thermoformed lower cup with a predetermined quantity of said granular product, said granular product having a top surface in the form of a composite of the uppermost granules of said product, said top surface being below said upper peripheral flange of said lower cup;

(c) substantially removing gases from inside said hollow cavity of said lower cup by subjecting said hollow cavity of said lower cup to vacuum;

(d) continuously sealing the distal edge of a substantially planar top lid having a bottom surface about said upper peripheral flange of said lower cup while said top lid, said hollow cavity and said lower cup are subjected to vacuum to form a sealed, substantially gas-free container;

(e) exposing said sealed, substantially gas-free container to atmospheric pressure;

(f) resubjecting said sealed, substantially gas-free container to vacuum;

(g) mechanically deforming said bottom wall of said lower cup into a concave impression of preselected size and shape extending into said hollow cavity of said lower cup at a preselected location, yet maintaining said top lid in a substantially planar condition while said sealed, substantially gas-free container is subjected to vacuum, thereby moving said top surface of said granular product into continuous contacting relation with said bottom surface of said substantially planar top lid; and (h) exposing said sealed, substantially gas-free container to atmospheric pressure, thereby causing said container to maintain said preselected, substantially solid shape until it is opened.

* * * * *

UNITED STATES PATENT AND TRADEMARK OFFICE

CERTIFICATE OF CORRECTION

PATENT NO. : 4,684,025

DATED : 8/4/87

INVENTOR(S) : DONALD S. COPLAND, LARRY D. HALSTEAD, LAWRENCE E. O'BRIEN

It is certified that error appears in the above-identified patent and that said Letters Patent is hereby corrected as shown below:

Column 2, line 23, "produce" should read -- product --.

Column 4, line 37, "produce" should read -- product --.

Column 4, line 54, "in" should read -- into --.

Column 4, line 58, "for" should read -- of --.

Column 5, line 25, "unattrative" should read -- unattractive --.

Column 5, line 31, after "holes" insert -- to --.

Column 5, line 57, "provided" should read -- providing --.

Column 8, line 15, "a" should read -- an --.

Column 8, line 33, after "of" insert -- said --.

Column 8, line 42, after "top" insert -- lid --.

UNITED STATES PATENT AND TRADEMARK OFFICE

CERTIFICATE OF CORRECTION

PATENT NO. : 4,684,025

DATED : 8/4/87

INVENTOR(S) : DONALD S. COPLAND, LARRY D. HALSTEAD, LAWRENCE E. O'BRIEN

It is certified that error appears in the above-identified patent and that said Letters Patent is hereby corrected as shown below:

Column 9, line 22, "granuels" should read -- granules --.

Column 9, line 35, "or" should read -- of --.

Signed and Sealed this

Twenty-sixth Day of January, 1988

*Attest:*

*Attesting Officer*

DONALD J. QUIGG

*Commissioner of Patents and Trademarks*